United States Patent [19]

Magno et al.

[11] 4,325,544

[45] Apr. 20, 1982

[54] COLLATOR WITH ADJUSTABLE SHEET ALIGNER

[75] Inventors: Robert Magno; Donald C. Roller, both of Boulder; Allan J. Rood, Longmont, all of Colo.

[73] Assignee: International Business Machines Corporation, Armonk, N.Y.

[21] Appl. No.: 146,948

[22] Filed: May 2, 1980

[51] Int. Cl.[3] ..... B65H 31/38; B65H 31/24

[52] U.S. Cl. ..... 271/221; 271/223; 271/287; 271/314

[58] Field of Search ..... 271/221, 222, 314, 287, 271/223, 224, 240, 178, 179, 306, 69, 113, 120; 414/36, 35; 270/58

[56] References Cited

U.S. PATENT DOCUMENTS

| | | | |
|---|---|---|---|
| 3,083,014 | 3/1963 | Howdle et al. | 271/221 X |
| 3,593,992 | 7/1971 | Hanson | 271/222 |
| 3,735,978 | 5/1973 | Turner et al. | 271/314 X |
| 3,900,115 | 8/1975 | Kumagai | 271/222 X |
| 3,910,568 | 10/1975 | Brown et al. | 271/221 |
| 4,134,672 | 1/1979 | Burlew et al. | 414/36 X |

*Primary Examiner*—Bruce H. Stoner, Jr.
*Attorney, Agent, or Firm*—Joscelyn G. Cockburn

[57] ABSTRACT

Sheet-like articles, such as paper, entering one or more support trays are aligned in one or more vertical stacks by a pair of rotating drive devices positioned vertically and adjacent to opposite sides of the support trays. The rotating drive devices include a plurality of resilient flaps mounted to a support member. The flaps are configured to reach over a stack of sheets thereby contacting a sheet on its top surface as well as on its edge.

8 Claims, 6 Drawing Figures

COLLATOR WITH ADJUSTABLE SHEET ALIGNER

BACKGROUND OF THE INVENTION

1. Field of the Invention

The invention relates to devices for aligning articles, and in particular, devices for aligning sheets or the like into edge-aligned stacks.

2. Prior Art

In handling planar articles such as paper sheets outputted from printers, presses and electrophotographic copiers, it is often required to stack the sheets into aligned stacks for operations such as cutting, stapling and binding. The process of forming stacks of aligned sheets may be done by mechanical means or nonmechanical means.

When sheets are properly aligned with one another by means of the human hands, the process is often referred to as nonmechanical. The partially-aligned stack of sheets is held by the hand. By tapping alternately adjacent edges of the sheet against a flat surface, forces the sheets into alignment. Although this procedure works satisfactorily, it is not well suited for commercial adaptation. Moreover, the procedure is time-consuming and expensive.

In an attempt to circumvent some of the disadvantages associated with human hands, mechanical devices have been used to align sheets. One type of prior art mechanical aligner consists of an inclined table with a pair of jogger arms pivotally mounted to the table. The jogger arms have a pair of paddle portions extending upwardly above the level of the table along two adjacent sides. The table is inclined towards the paddle portions of the jogger arm. As such, a gravitational force is imparted to the sheets along the direction of the incline. The force helps to bring the sheets into alignment. A driving means consisting of a motor-driven camming system activates the jogger arms which causes pivotal movement of the paddles. The paddles tap against the sides or edges of the sheets delivered on the table to form a properly aligned stack. A more detailed description of the above prior art joggers is given in U.S. Pat. No. 3,593,992.

Another type of prior art aligners is described in U.S. Pat. No. 3,083,014. In that patent, sheet-like articles to be formed into edge-aligned stacks are delivered serially to a stacker and jogger mechanism. The trailing end and leading end of the sheets are overlapped. The stacker and jogger mechanism consists of an alignment surface and a movable table for supporting the sheet articles. Two pair of resilient bladed rotating paddle wheels are mounted relative to the table. One pair of the paddle wheels is disposed on opposite edges or sides of the table. The paddle wheels in each pair are in spaced relation on its respective side of the table. The paddles are inclined with respect to the table. As sheet-like articles are delivered to the table, in the direction of paddle rotation, the rotating resilient paddle wheels contact and lightly impact the opposite edges of the sheets to impart a jogging or vibratory action which aligns the sheet-like articles against the alignment surface.

Although the above-described aligners probably work well for their intended purpose, there are times when the above aligners do not align the sheets with sufficient accuracy. For example, if some of the sheets in a particular size classification (such as $8\frac{1}{2}'' \times 14''$ etc.) are slightly less than the stated size for that classification. The inability of the aligners to accurately align sheets in a stack wherein the dimension of some sheets are slightly less than the stated dimension stems from the fact that the prior art aligners all work on the edges of the sheets. The smaller sheets in a mixed size stack do not extend to the edges of the stack, therefore, tapping on the side of the stack does not align the sheets since there is no contact between the tapping element and the smaller size sheets.

SUMMARY OF THE INVENTION

It is therefore the object of the present invention to align sheets in a more efficient manner than was heretofore possible. The objective is achieved by an aligner which contacts the sheet on both its edges and on its top surface to align the sheet against one or more reference surfaces.

The paper sheet aligner assembly includes one or more sheet support trays for supporting sheets delivered from a sheet delivery mechanism. The trays are arranged in a horizontal orientation. A pair of rotating aligning members carrying a plurality of slotted flappers are mounted vertically with respect to the trays and on opposite sides thereof. As sheets enter the trays, the rotating aligning members contact the sheets on its topmost surface and on its edge, and align the sheets to form a stack within the trays.

In one feature of the invention, one of the rotating members is adjustable so that sheets with different paper lengths are accommodated.

In another feature of the invention, one of the rotating members is a rotating bar. The bar may be coated with a high coefficient of friction coating or a series of spaced longitudinal slots may be disposed on the surface of the bar. The slots increase the coefficient of friction between the paper and the rotating bar.

The foregoing and other features and advantages of the invention will be apparent from the following more particular description of the preferred embodiment of the invention, as illustrated in the accompanying drawings.

DETAILED DESCRIPTION OF THE PREFERRED EMBODIMENT

Although the present invention finds use in any environment where it is required that sheet-like material such as paper be aligned in vertical, edgewise stack, the present invention works well to align sheets in a multi-bin collator module. In this environment copy sheets are supplied from a reproduction machine such as a convenience copier in a sequential manner to the bins of the collator. As such, the invention will be described in such an environment. However, this should not be construed as a limitation on the scope of the present invention since it is the intent that the invention be used in any environment where it is necessary to align sheet-like material.

Figure 1:
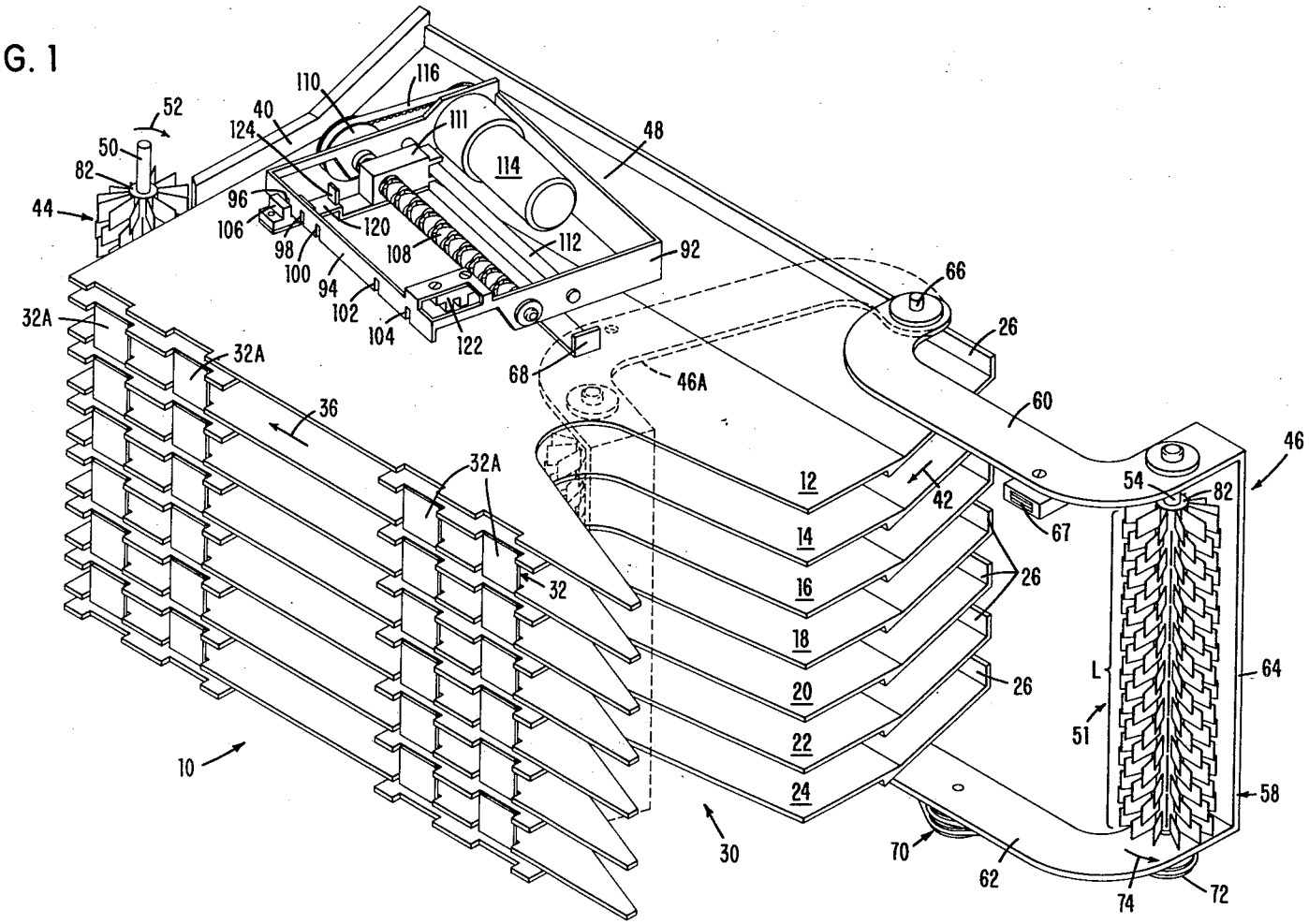
FIG. 1 shows a perspective view of a collator module having a pair of slotted aligners disposed for cooperating and aligning sheets within the bins of the collator. Conventional components such as support frames and power supplies are omitted.

Referring now to the drawings and, in particular, to FIG. 1, a perspective view of a collator module 10 and an alignment assembly, according to the teaching of the present invention, is shown. The showing in FIG. 1 omits conventional components such as support frames, power supplies, etc. The conventional components are state of the art components which can be implemented by an artisan having ordinary skill in the art. Therefore, incorporating such components would necessarily obscure the inventive feature of the present invention. Suffice it to say that the collator module and the alignment assembly are fastened to a frame assembly. The frame assembly (not shown) includes a top support plate which is positioned above bin 12 and a bottom support plate which is positioned below bin 24. The top and bottom support plates are interconnected by side members. The members of the frame assembly are welded to ensure structural integrity of the assembly.

Still referring to FIG. 1, the alignment assembly coacts with sheets entering the bins of collator module 10 to form edgewise aligned vertical stacks therein. The collator module 10 includes a plurality of receptacles or bins. In the drawing, only seven bins, 12–24, are shown. It being understood that any number of bins can be fabricated within the module. Each of the bins are fitted with a rectangular lip 26. The rectangular lips extend above the bottom surfaces of the bins. The bins are also fitted with a plurality of U-shaped slots 30. As will be explained subsequently, the slots allow one of the rotary aligners to be adjusted so that the collator module can accommodate paper size of variable lengths. For example, paper having lengths of 14 inches, 11 inches, etc. Each of the bins are fitted with an exit gate. In the figure, only one of the gates is shown. The gate is identified as exit gate 32. It being understood that each of the other bins is fitted with a gate identical to exit gate 32. The exit gates include a plurality of finger members 32A, extending upwardly from a support shaft positioned on the underside of the bin bottom surface. As will be explained subsequently, the upwardly extending finger members 32A function as a reference edge against which sheets in the bin are aligned.

Figure 6:
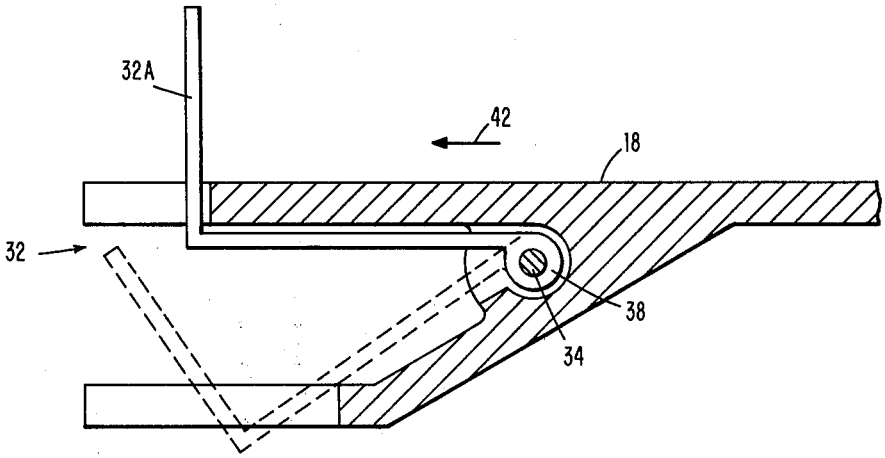
FIG. 6 shows a cross-section of the exit gate and a support bin. The gate periodically acts as a secondary reference surface.

Turning to FIG. 6 for the moment is a cross-section of the exit gate 32. The cross-section shows the interrelation between the exit gate and the bin. The exit gate 32 includes a shaft 34. The shaft is positioned on the undersurface of bin 18. The shaft is orientated to run in a direction parallel to arrow 36 (FIG. 1). The length of the shaft is substantially equivalent to the length of the bin. A plurality of upwardly extending fingers 32A are coupled onto the shaft in spaced-apart relationship by a coupling 38. Each of the shafts 34, which runs parallel to a bin, is interconnected by means of a mechanical linkage (not shown) to a plurality of solenoids. When the solenoid for a particular shaft such as 34 is picked, the upwardly extending finger 32A is pulled away from the associated bin to a position shown by phantom lines in FIG. 6. When the exit gate 32 is in the down position, an unloading means such as a mechanical device (not shown) can be inserted into the bin 18 to remove the stack of aligned sheets therein. Similarly, when the gate is in the up position, then paper which is hurled into the bin in a direction parallel to arrow 42 (FIG. 1) is constantly forced by the alignment members for alignment against said gate and the back reference 40 (FIG. 1).

Returning now to FIG. 1, the bottom surface for each of the bins 12 through 24 are fitted with a sloping profile. The slope begins at points adjacent to the lip members 26 and exit gates 32 and converges towards the center of the bins. Each of the bins 12 through 24 abuts against a fixed reference surface 40. Sheets which are forced into the bins along the direction shown by arrow 42 are forced against the flat surface of the fixed reference member for alignment. As will be explained subsequently, a fixed rotating aligner 44 is positioned to run traversely to the bins.

Figure 2:
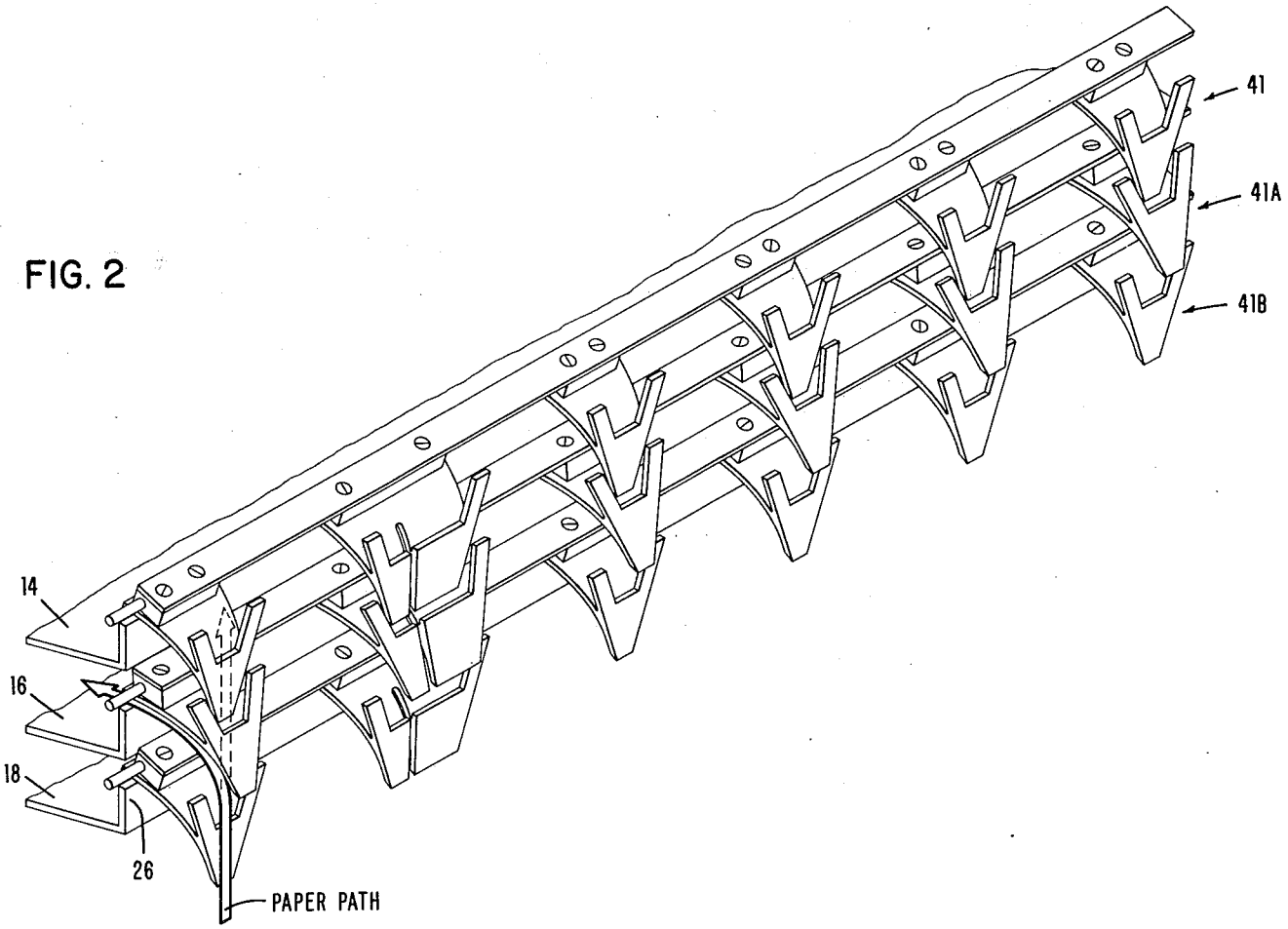
FIG. 2 is a perspective view showing the side of the collator module which coacts with the output section of a document reproduction machine.

Turning now to FIG. 2 is a drawing showing the side of the collator module which interfaces with the output path of a document reproduction machine. As documents are outputted from the reproduction machine, they are conveyed in seriatim by a conveyor means such as a vacuum belt system or other state of the art document transport device. The documents are hurled over lip members 26 into the respective bins of the collator module. Each of the bins is fitted with an entry gate, three of which are shown and identified as 41, 41A and 41B. It is understood that each bin is fitted with an identical entry gate. The entry gate includes a plurality of spaced finger members mounted to a rotating shaft and extending downwardly therefrom. As with the exit gates previously described, each of the shafts are coupled via a mechanical linkage to a plurality of solenoids (not shown). As sheets are outputted from the reproduction system and transported on the conveying means, a solenoid for a particular gate, in this case gate 41A is picked, and the sheet is hurled into the bin. Similarly, if a solenoid is not picked, then the sheet does not enter into its associated bin.

Referring again to FIG. 1, the alignment assembly includes a fixed rotating aligner 44, an adjustable aligner 46 and a paper size adjusting assembly 48.

The aligners 44 and 46 respectively, coact with sheets entering the bins to form edgewise aligned stacks within each bin. The adjusting assembly 48 coacts with the movable aligner 46 so that variable size sheets are allowed to enter the collator bins. The fixed aligner 44 is mounted to a shaft 50. The shaft is journaled to the upper and lower support plates of the frame assembly (not shown). As will be explained subsequently, a pulley belt arrangement couples the shaft to a conventional DC servo motor. When the motor is energized, the shaft is rotated in the direction shown by arrow 52. As the shaft is rotated, the plurality of flappers which are mounted on fixed rotary aligner 44, coact with the edge and top surface of sheets entering the bins thereby aligning the same against fixed referenced member 40 and movable gate assembly 32. Fixed rotary aligner 44 is positioned so that the flappers extend slightly above the flat alignment surface of the fixed referenced member 40.

Figure 5:
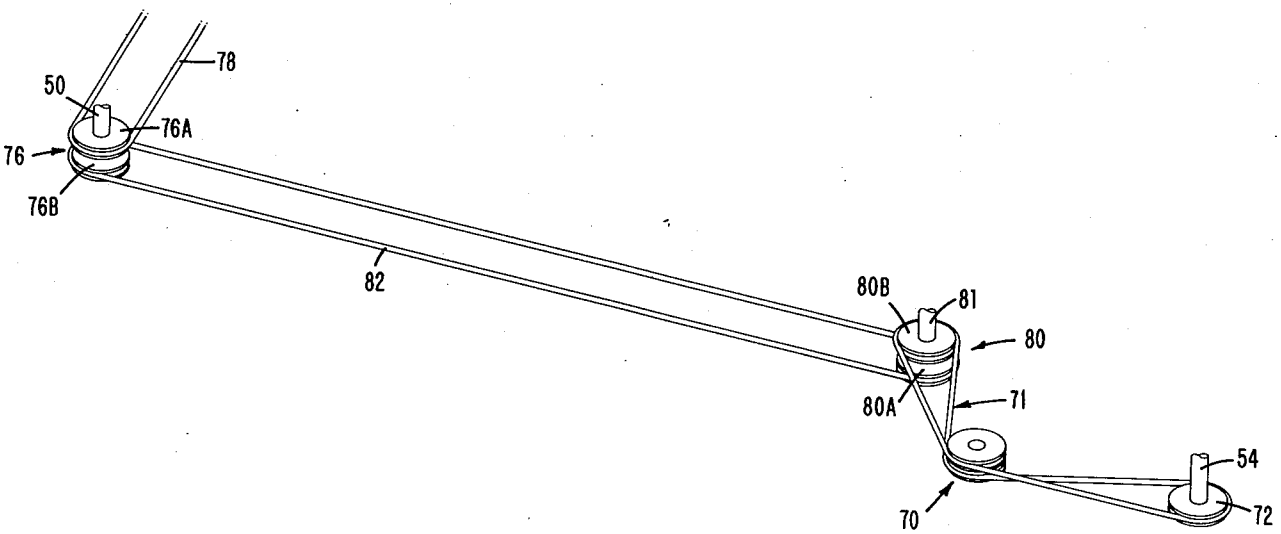
FIG. 5 shows a pulley belt assembly for rotating the aligners.

The adjustable rotary aligner 46 includes a rotary cylindrical aligner member 51. The aligner member is substantially identical to rotary aligner 44. The only difference is that the spirals which separate the flaps descend in opposite directions. Detailed description of the aligners will be given hereinafter. Suffice it to say at this point that rotary aligner member 51 includes a plurality of flaps and is mounted to shaft 54. The shaft is journaled for rotation in support bracket 58. The support bracket 58 includes a U-shaped top support plate 60 and a U-shaped bottom support plate 62. A planar support plate 64 interconnects the top and bottom U-shaped plates, respectively. The rotary aligner member 51 is journaled for rotation on one of the vertical sides of the U between the upper and lower support plates. The other vertical side of the U-shaped members are journaled for rotation about pivot points (not shown) on the support frame. By way of example, the upper U-shaped support plate 60 pivots about upper pivot shaft 66. Shaft 66, in turn, is coupled to the upper support plate of the frame (not shown). Similarly, the lower U-shaped support plate 62 pivots about a lower pivot shaft 81 (FIG. 5). The lower pivot shaft 81 is coupled to the lower support plate of the frame assembly (not shown). As can be seen from FIG. 1, the adjustable rotary aligner 46 can be pivoted about the upper and lower pivot shafts from a first position (shown in phantom lines) and identified by numeral 46A to the outermost position shown in solid line and identified by numeral 46. A magnet 67 is mounted to the upper U-shaped support plate 60. As will be explained subsequently, the magnet 67 coacts with magnetic keeper 68 to keep the aligner in a locked position once a paper size is selected. By way of example, when the adjustable aligner is in the position shown by numeral 46A, the aligner is in a locked position and will allow paper having a particular size (say 10") to be aligned in the bins.

The fixed rotary aligner 44 may be a fixed rotary solid bar. To increase the coefficient of friction between the bar and the sheets, a high coefficient of friction coating is placed on the bar. Singly or together with the coating, a plurality of longitudinal slots can be placed on the bar. The slots improve the coefficient of friction between the bar and the paper.

A double pulley 70 is mounted to the undersurface of the U-shaped bottom support plate 62. Also, a single pulley 72 is fixedly mounted to shaft 54. As will be explained subsequently, a belt drive system including pullies 70, 72 and a plurality of interconnecting belts (not shown) interconnects pulley 70 and 72 through a double pulley located at the lower pivot point (not shown) to a pulley attached to shaft 50 of the fixed aligner 44. A single DC servo motor driving the pulley attached to the lower part of shaft 52 rotates rotary aligners 44 and 51 in clockwise and counterclockwise directions shown by arrows 52 and 74 respectively. Of course, the direction of rotation may be interchanged without departing from the scope of the present invention. The opposite direction of rotation between the aligners is achieved by double pulley 70. The pulley also functions to create tension in the drive belt.

Turning now to FIG. 5 is a diagram showing the pulley drive belt system which imparts rotary motion to the rotary aligners. Elements in this figure which are identical to previously described elements will be identified with the same numeral. A double pulley assembly 76 is fixedly mounted to the lower extending end of shaft 50. As can be seen from FIG. 1, shaft 50 supports rotary aligner 44. A pulley belt 78 interconnects one of the double pullies 76A to a pulley (not shown) mounted to the rotated shaft of a DC servo controlled motor (not shown). A second double pulley assembly 80 is mounted in spaced relation with the double pulley 76. The double pulley assembly 80 is mounted to lower pivot shaft 81. The lower pivot shaft 81 is mounted to the lower support plate (not shown) at the frame.

The lower U-shaped support bracket 62 (FIG. 1) is pivotally coupled to lower pivot shaft 81. The double pulley assembly 80 and lower pivot shaft 81 are positioned at the lower pivotal point for adjustable aligner assembly 46. Although not shown in FIG. 1, the double pulley assembly is positioned at a point on the lower frame plate in spaced but linear alignment (that is directly below upper pivot shaft 66). Pullies 76B and 80A of double pulley 76 and 80, respectively, are grooved or geared pullies. The grooves or gears are fabricated on the outside of the pullies. A pulley belt 82 which is grooved on its inner surface interconnects pullies 76B and 80A respectively. By grooving the pullies and belt respectively the driving force between the pullies and the belt is enhanced. It is worthwhile noting at this point that the lower U-shaped bracket 62 (FIG. 1) only pivots about shaft 81 upon which the double pulley 80 is mounted. Double pulley assembly 70 is positioned in spaced alignment to double pulley assembly 80. As was stated in reference to FIG. 1, double pulley assembly 70 is mounted to the undersurface of lower U-shaped bottom support plate 62. Single pulley 72 is coupled at the underside of U-shaped bottom support plate 62 to shaft 54 (FIG. 1).

A pulley belt 71 (FIG. 5) interconnects pulley 80B and pulley 72. Double pulley assembly 70 which is positioned between pulley 80 and 72 coacts with the belt to provide belt tension adjustment and to change the direction of belt travel so that the rotary aligner 51 (FIG. 1) rotates in the opposite direction to rotary aligner 44. In operation, a control signal is applied to the DC servo motor (not shown). As the motor shaft (not shown) begins to rotate, the motion is transmitted through the belt and pulley system of FIG. 5 so that the rotary aligners are rotated in opposite directions thereby aligning sheets hurled into the bins against referenced surface 40 and exit gate assembly 32. It is worthwhile noting that it is within the skill of the art to rotate the aligners with other drive means without departing from the scope or spirit of the present invention.

As was stated previously, rotating aligner 51 and rotating aligner 44 are substantially identical, therefore the description which follows hereinafter are equally applicable to either one of the aligners. Referring now to FIG. 1, the rotary aligner comprises a plurality of resilient flaps coupled to a cylindrical hub member 82. The hub member is coupled to a shaft which is journaled for rotation. The length L of the aligner runs transversely to the number of bins in the collator module. One of the aligners such as 44 is fixedly mounted relative to a fixed reference edge against which sheet-like materials are aligned. The other aligner is mounted on a pivotable support bracket and is positioned on the side of the collator opposite from the referenced surface. The adjustable rotary aligner 51 is positioned so that its engagement with sheets (not shown) in the collator bins is approximately twice the engagement of fixed rotary aligner 44 with sheets in said bin. Stated another way, the movable rotary aligner is biased towards referenced surface 40. As such, lateral stacking of the incoming sheets against the referenced surface is assured.

Figure 3:
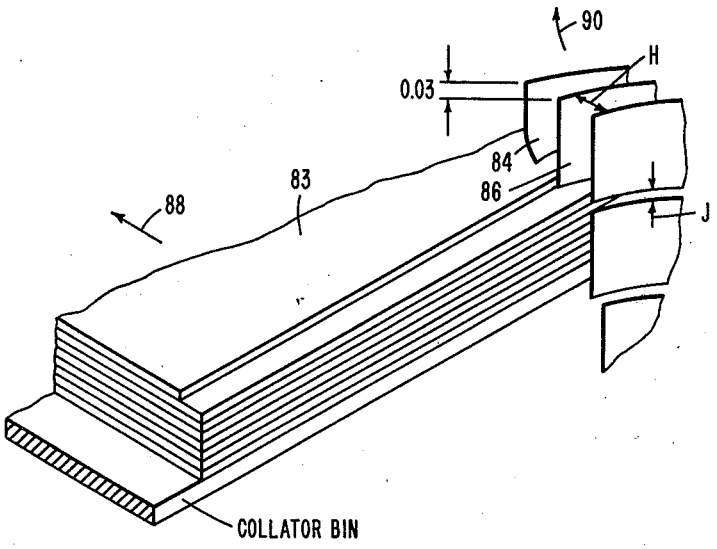
FIG. 3 is a perspective view of the slotted rotary aligners. The aligner includes a plurality of flaps disposed for contacting both the edges and top surface of sheets in the bins.

Referring now to FIG. 3 is an enlarged view of the resilient flaps which are mounted on hub 82. The flaps are disposed in spaced relation (H) around the circumference of the hub 82 and are separated by angled slots (J) along the major axis of the cylindrical hub. The flaps are fabricated from resilient material such as hard rubber. The rubber is chosen to have a relatively high coefficient of friction which neither marks (that is scars) the paper nor wears down excessively. Although it is within the skill of the art to select material having the recited characteristics, in the preferred embodiment of this invention a material called "WHITE HYPALON" (having a thickness of approximately 0.025") is used.

Although there are a plurality of methods to arrange the resilient flappers onto support hub 82, in the preferred embodiment of this invention two methods were used to arrange the flappers onto the hub. In one method a plurality of axial grooves are machined into the circumference of the hub member 82 (FIG. 1). The grooves extend in a direction parallel to the length (L) of the hub. The grooves are also positioned in spaced relation. A plurality of solid or nonslotted flappers are attached in the grooves. A series of slots are cut in the solid flappers so that succeeding slots are positioned $\sigma$ inches lower than preceding slots. In the preferred embodiment of this invention, $\sigma$ is substantially equivalent to 0.003 inches. By way of example and with reference to FIG. 3, assuming that flap 84 was the first slot measured, the direction of measurement is assumed to be from top to bottom, then flap 86 would be 0.030 inches lower than flap 84. As such, the flaps are separated by descending slots J (FIG. 3).

Another method which is used to fabricate the flaps on the hub is that the flaps are molded. Each molded piece has a planar backing and a plurality of spaced flappers extending upwardly from the backing. The mold used to fabricate the flaps has a planar surface with a plurality of linear compartments extending upwardly therefrom. The material from which the flappers are manufactured and poured into the mold in a molten form. After curing, the flaps are removed from the mold and wrapped in helical fashion to the support hub. A fastening agent such as an adhesive is used for fastening the flappers to the hub. The descending slots (J) between the flappers are generated by the pitch of the helix.

FIG. 3 also shows the relationship between the resilient flaps and the sheets which are formed into edgewised-aligned stack within the collator bins. The showing is helpful in describing the advantages which inure to one who uses the rotary flappers for aligning sheets. The directions of alignment are parallel to the directions shown by arrows 88. As is evident from the drawing, as the aligner rotates in a direction shown by arrow 90, the flappers contact sheets along their edges and on the top surface thereof. As such, the sheets experience two forces: namely, one on the edge and one on the top. The forces quiet the sheet in the collator bin and forces the sheet for alignment against the reference surfaces. More important, however, due to the slots separating the flappers, the flappers are free to reach over the stack to contact sheets such as sheet 83 which may be slightly undersize. It is worthwhile noting that a pair of rotating brushes can be used to align the sheets. Alternately, a rotating brush and a rotating solid bar or a rotating member with flappers thereon and a solid bar can be the alignment members.

Referring again to FIG. 1, paper size adjusting assembly 48 functions to adjust movable aligner assembly 46 to enable variable sized sheets to be collated within the collator. The adjusting assembly includes a support bracket 92. The support bracket is connected to the top support plate of the frame (not shown). A linear tachometer scale 94 is coupled to the support bracket 92. The linear tachometer scale is fitted with a plurality of openings identified as openings 96 through 104. Each of the openings correspond with an assigned paper length. For example, opening 96 is the identifying mark for 10" length paper. Similarly opening 98 represents another size paper and so on. It should be noted that although five openings (that is five paper sizes) are identified on the linear scale, this should not be construed as a limitation on the scope of the invention since it is within the skill of the art to correlate the openings with different size paper without departing from the scope of the present invention. In addition to identifying one of the paper sizes which can be aligned in the collator, opening 104 also identifies the home position or initial position from which sensor assembly 106 begins to count in order to adjust rotary aligner 46 to accommodate a selected paper size. A lead screw 108 having reversing threads thereon is journaled for rotation between opposite sides of the support bracket. A pulley 110 is mounted to the shaft of the lead screw. A shaft 112 is positioned in spaced relation with the lead screw. The shaft is connected at its opposite ends to the opposite sides of the support bracket 92 and runs parallel to the lead screw. The sensor assembly 106 includes a positioning block 111 which is mounted to the lead screw and the shaft respectively. The shaft stabilizes the sensor assembly and prevents the assembly from pivoting about the lead screw. The sensor assembly 106 includes a light-emitting means such as an LED (light emitting diode) 106A (FIG. 4) and a light sensitive means such as a phototransistor 106B. The LED and the phototransistor are positioned on opposite sides of the linear tachometer scale 94. Magnetic keeper 68 (FIG. 1) is coupled to positioning block 111. The lead screw and the sensor assembly 106 is driven by a servo-controlled motor 114. A drive belt 116 interconnects the pulley 110 mounted on the shaft of the lead screw and the pulley mounted on the shaft of motor 114. Instead of using an automatic paper size adjusting assembly as is described above, the paper size adjusting assembly may be manual and selection is made by an operator.

As was stated previously, opening 104 represents two functions. Essentially when the sensor assembly is aligned with opening 104, it represents one size paper, for example, a 14" paper. Similarly, opening 104 also represents the initial or home position for the positioning assembly. To define the home position, a fixed sensor assembly is positioned within the vicinity of opening 104. An opaque planar screen element which extends above surface 120 of the movable sensor assembly coacts with the fixed sensor assembly to output an electrical signal indicative of the home position.

Figure 4:
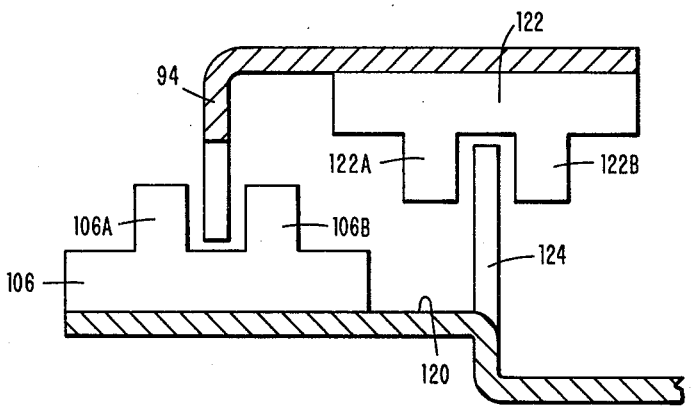
FIG. 4 is a cross-sectional sketch of the paper size adjusting assembly. The paper size adjusting assembly adjusts one of the rotary aligners so that the collator module stacks variable size sheets.

Turning now to FIG. 4 is a sketch showing the movable sensor assembly 106 and the fixed sensor assembly 122. As with the movable sensor assembly 106, the fixed assembly 122 has a light emitting source 122A and a light receiving means 122B. When the opaque screen 124 is positioned between the light emitting and light receiving means of stationary sensor assembly 122, a signal is outputted indicating that the movable sensor assembly is in its home position and by counting the number of slots between receipt of the initial pulse and a controlled signal generated by aligning the sensor assembly 106 with one of the slots on linear tachometer 94, a controller determines when the movable sensor assembly is aligned with an opening corresponding to a selected paper length. The controller can be a microprocessor or a conventional electrical circuitry.

OPERATION

In operation, the operator selects on a control panel (not shown) the paper size which will be outputted from the convenience copier into the collator bins. Once the selection is made, a control signal is outputted to the servo-controlled motor 114 (FIG. 1). The motor drives the sensor assembly 106 until opaque screen 124 (FIG. 4) is positioned between stationary sensor assembly 122. At this point a control signal is outputted and the system controller sets a counter with the signal outputted from the stationary sensor assembly. The motor continues to drive the movable sensor assembly 106. The counter is incremented/decremented until the sensor is aligned with the slot corresponding with the selected paper size. A second signal is outputted from the movable sensor. This signal stops the counter. The count which is trapped in the counter is compared with a stored count. If the counts are identical, the motor is deactivated and the keeper 68 is positioned at a point which allows movable aligner 51 to coact with the selected size sheets coming in the bins to align the same.

The magnet 66 is now fastened to magnetic keeper 68. The rotating aligners continuously drive the incoming copy sheets up against registration surface 40 and exit gates 32 respectively. As the sheets are hurled into the bins in the direction shown by arrow 42 (FIG. 1), they are contacted by stationary aligner 44 and adjustable aligner 51 where it is driven up against reference edge 40 and gate 32. The aligners 44 and 51 are positioned so that they engage the leading edge of an incoming copy sheet before the trailing edge thereof leaves the feed mechanism which feeds the sheet from the convenience copier path into the bins. Also the average surface speed of the alignment members is such that a copy sheet is pulled from the feed assembly (not shown) which feeds the sheets into the bins thereby eliminating possible buckling of the sheet. Also, the engagement of adjustment aligner 51 is such that the amount of overlapping into the sheet is about twice that of stationary aligner 44. This assures a biasing force towards reference edge 40 which produces even, lateral stacking of the copy sheets.

While the invention has been particularly shown and described with reference to preferred embodiments thereof, it will be understood by those skilled in the art that various changes in form and details may be made therein without departing from the spirit and scope of the invention.

What is claimed is:

1. A sheet handling apparatus for stacking variable size sheets, said apparatus comprising:

a paper support module having at least one bin for supporting the sheets;

a sheet transport means positioned relative to said bin and operable to deliver sheets in seriatim to said bin;

a first fixed position rotary aligning member positioned relative to the bin with an axis of rotation running substantially perpendicular to the plane of the bin;

said rotary aligning member having resilient slotted flappers thereon for contacting and aligning sheets entering the bin;

an adjustable position rotary aligning member positioned relative to the bin and in spaced relation with the first rotary aligning member, said adjustable position rotary aligning member having resilient slotted flappers thereon for contacting and aligning sheets entering the bin, and its axis of rotation running substantially perpendicular to the bin; and an adjustable means associated with the adjustable position aligning member and operable to adjust the position of the adjustable position aligning member to enable the bin to accommodate variable size sheets.

2. The apparatus of claim 1 further including a first drive means for driving the rotary alignment members.

3. The apparatus of claim 1 further including:

a fixed reference surface; and a movable reference surface, said fixed and movable reference surfaces are coupled to adjacent sides of the bin and operable to support the edges of the sheets.

4. In a sheet accumulating device such as a collator having at least one horizontally disposed bin and means for aligning sheets entering the bin, the improvement comprising:

a fixed and a movable position drive roller disposed in a vertical orientation and adjacent opposite sides of the bin;

each drive roller having a plurality of flaps thereon, said flaps being operable to contact the sheets on the edge and top surface to allow alignment of undersized sheets;

an adjustment device operable to adjust the position of the movable position roller to enable the bin to accommodate variable size sheets; and a locking device operable to lock the movable position roller following its adjustment.

5. In a collator having a plurality of vertically disposed collator bins and means for aligning copy sheets as the sheets enter the bin, the improvement comprising:

a fixed position rotary aligning member disposed vertically on one side of the collator bins;

an adjustable position rotary aligning member disposed vertically on an opposite side of the collator bins;

a paper size adjustment means positioned relative to the collator bins and operable to adjust the position of the adjustable position rotary aligning member so that sheets of variable sizes are aligned within the bins; and means for locking the adjustable position rotary aligning member in adjusted position.

6. The sheet handling apparatus of claim 1 wherein the adjustable means includes a support frame;

a linear tachometer strip coupled to the frame;

an elongated lead screw journaled for rotation in the support frame, said lead screw being disposed in spaced relation to the linear tachometer strip and running in a general direction parallel to the linear tachometer strip;

a distance measuring device coupled to the lead screws; and a motor for driving the lead screw so that the distance measuring device traverses the tachometer strip and outputs signals representing the paper size which the bin can accommodate.

7. The sheet handling apparatus of claim 1 further including a latching means operable to latch the adjustable aligning member after a sheet size selection.

8. The sheet handling apparatus of claim 7 wherein the latching means includes a magnetic keeper and a magnet mounted to the adjustable aligning member.

* * * * *